United States Patent [19]

Godsay et al.

[11] Patent Number: 4,622,100

[45] Date of Patent: Nov. 11, 1986

[54] PROCESS FOR THE DELIGNIFICATION OF LIGNOCELLULOSIC MATERIAL WITH OXYGEN, FERRICYANIDE, AND A PROTECTOR

[75] Inventors: Madhu P. Godsay, Monroe; Michael N. Hull, Bardonia; Vacheslav M. Yasnovsky, Orangeburg, all of N.Y.

[73] Assignee: International Paper Company, New York, N.Y.

[21] Appl. No.: 656,299

[22] Filed: Oct. 1, 1984

[51] Int. Cl.[4] ..... D21C 9/147

[52] U.S. Cl. ..... 162/65; 162/72; 162/77; 162/79; 162/96

[58] Field of Search ..... 162/65, 72, 77, 76, 162/70, 79, 50

[56] References Cited

U.S. PATENT DOCUMENTS

| | | | |
|---|---|---|---|
| 1,780,750 | 11/1930 | Horn | 8/110 |
| 2,214,845 | 9/1940 | Wells | 8/110 |
| 2,477,631 | 8/1949 | Levy et al. | 8/105 |
| 2,828,253 | 3/1958 | Kurz et al. | 204/132 |
| 3,489,742 | 1/1970 | Gerull | 260/212 |
| 3,695,994 | 10/1972 | Worster et al. | 162/65 |
| 3,769,152 | 10/1973 | Samuelson et al. | 162/65 |
| 3,843,473 | 10/1974 | Samuelson et al. | 162/40 |
| 3,929,559 | 12/1975 | Procter | 162/70 |
| 3,951,732 | 4/1976 | Sjostrom et al. | 162/65 |
| 4,002,526 | 1/1977 | Brown et al. | 162/57 |
| 4,004,967 | 1/1977 | Swan et al. | 162/65 |
| 4,050,981 | 9/1977 | Jamieson et al. | 162/65 |
| 4,091,749 | 5/1978 | Procter et al. | 162/25 |
| 4,141,786 | 2/1979 | Eckert | 162/40 |
| 4,229,252 | 10/1980 | Meredith et al. | 162/65 |

FOREIGN PATENT DOCUMENTS

| | | | |
|---|---|---|---|
| 942958 | 11/1963 | United Kingdom . | |
| 596687 | 3/1970 | U.S.S.R. | 162/79 |

OTHER PUBLICATIONS

"A Study of Some of the Variables in Bleaching Pulp in an Electrolytic Cell" by David R. Gustafson in TAPPI, 42, pp. 612 to 616, (1959).

"Chlorine-Free Ways of Electrochemical Bleaching of Pulp" E. I. Chupka, et al. Bumazhnaya Promyshlennost (Paper Industry, USSR), N11, 20-21, 1978.

"Electrochemical Way of Bleaching of Kraft Pulp" S. R. Stromsky, E. I. Chupka, Wood Chemistry, USSR, 1978, N4, 11-14.

*Primary Examiner*—Steve Alvo

*Attorney, Agent, or Firm*—Walt Thomas Zielinski

[57] ABSTRACT

The use of primary and secondary amines and certain other compounds in ferricyanide assisted oxygen delignifying bleaching of lignocellulosic pulps permits more rapid removal of a desired amount of lignin from the pulp and, hence, the retention of higher pulp viscosity.

16 Claims, 1 Drawing Figure

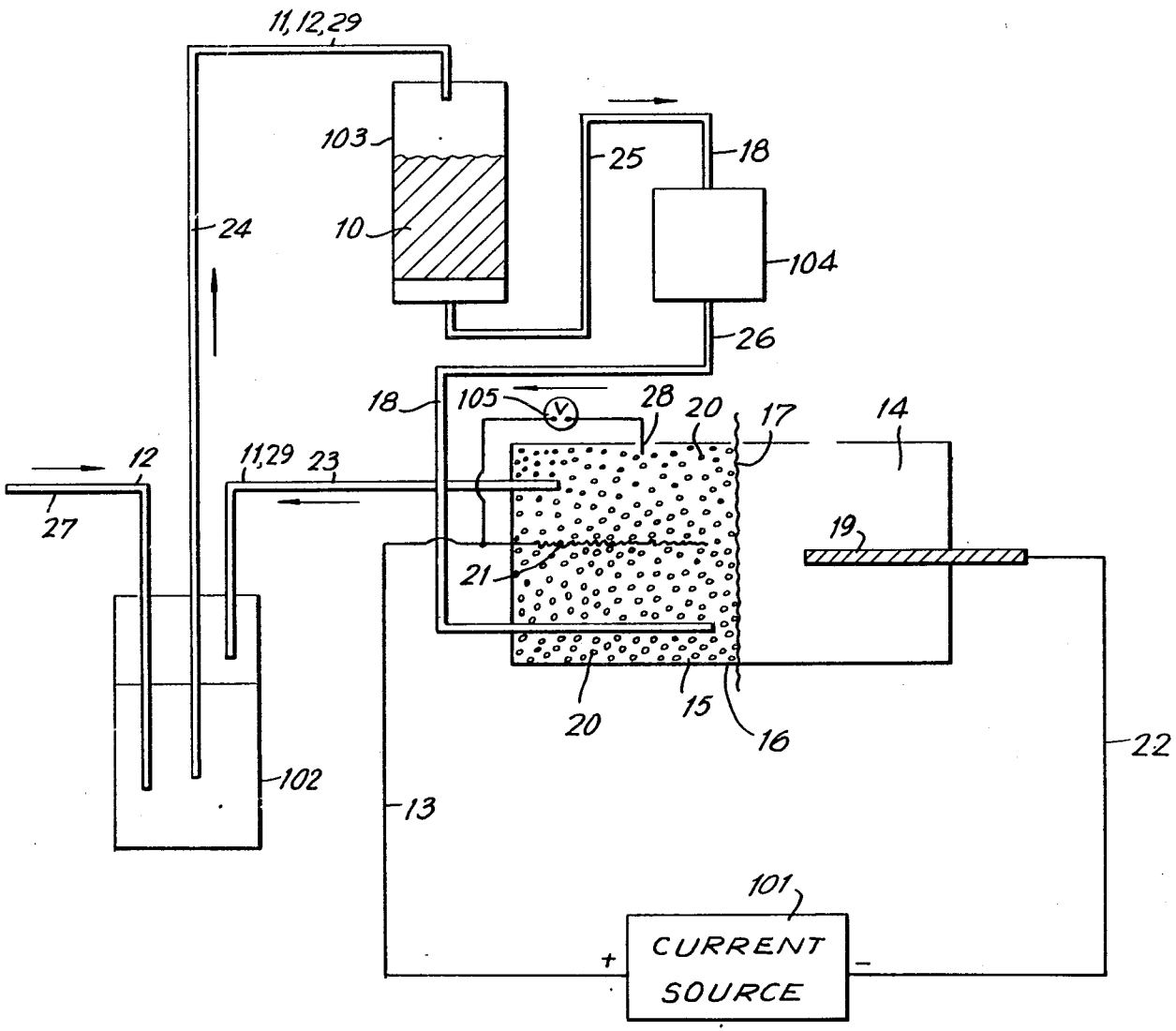
CURRENT SOURCE
+
-
V
10
11,12,29
11,29
12
13
14
15
16
17
18
19
20
21
22
23
24
25
26
27
28
101
102
103
104
105

PROCESS FOR THE DELIGNIFICATION OF LIGNOCELLULOSIC MATERIAL WITH OXYGEN, FERRICYANIDE, AND A PROTECTOR

BACKGROUND OF THE INVENTION

This invention relates to both electrochemical and oxygen bleaching or delignification of lignocellulosic materials particularly wood chips and pulp and more particularly to wood pulp prepared by standard pulping methods, especially alkaline pulping methods, more specifically to retardation of the loss of cellulose viscosity which occurs during such bleaching process, and to products prepared thereby and processes for their use.

Chemical pulp is prepared by treating lignocellulosic material with various "pulping chemicals" to render soluble the major portion of the non-carbohydrate portion of the material. The most common chemical pulp is pulp prepared from wood chips by the "kraft" or sulfate process. In this process the wood chips are treated under heat and pressure with sulfide ions in a strongly alkaline aqueous medium. The resulting pulp, while quite strong, is highly colored probably due to a large number of chromophores in the residual lignin. "White" papers are prepared from such pulps and from other chemical pulps by bleaching which principally comprises further delignification. The usual way this is accomplished is by treatment with chlorine-based chemicals such as chlorine, chlorine dioxide, hypochlorite and other oxidative chemicals which oxidize and solubilize the remaining lignin and, thus, remove the chromophoric material.

Recently other oxidative processes employing materials such as oxygen, ozone, peracids and peroxides have been suggested as alternatives to reduce or replace the need for chlorine based chemicals in the bleaching of pulps. For a number of reasons, well known to those in the art, oxygen has proven to be of particular interest and bleaching sequences employing oxygen which are intended to reduce the use of chlorine based chemicals are in commercial operation. Oxygen is a powerful oxidant. It significantly depolymerizes cellulose in pulp at the same time it is reacting with and solubilizing the highly chromophoric residual lignin. Cellulose destruction is aggravated by the severe reaction conditions (temperatures greater than 90° and oxygen pressures exceeding 70 psi) required for standard oxygen-based bleaching sequences as presently practiced.

Cellulose destruction or depolymerization which is commonly measured by a fall in viscosity as measured by standard pulp viscosity tests, adversely affects the physical properties of paper made from pulp. Reduction of the severity of the conditions employed in oxygen bleaching reduces the tendency towards cellulose destruction. Because conventional oxygen bleaching processes proceed at a rate too slow to be commercially useful under such less severe conditions, one convenient means to use less severe conditions is through the use of catalysts which accelerate the reaction between lignin and oxygen. Several such catalysts are known. They are Salcomine (an ethylenediamine-bis-salicylaldehyde complex of cobalt), ortho-phenanthroline, and manganese salts. These catalysts are not suitable for practical commercial use because they are relatively expensive due to the fact that they cannot be recovered and regenerated conveniently.

One way to generate or regenerate a catalyst for oxygen bleaching is the use of electrochemical treatment of the precursor or spent catalyst, respectively.

Electrochemical generation of oxidants or other "electron carriers" in situ or in a closed cycle process in pulp bleaching and even in some pulping processes for lignocellulosic material has been experimented with in the past but, as far as is known, with little or no practical success and these processes have never been used commercially.

Electrochemically generated compounds such as hypochlorite, hydrogen peroxide and the like have been shown to react with and solubilize lignin. However, compounds lacking an oxygen function, for example ferricyanide, will react with but not solubilize lignin to any practical extent unless some oxygen is also present. The prior art has not recognized the importance of the oxygen that was present in providing its reported results and, hence, has not recognized that compounds such as ferricyanide when present in catalytic amounts together with deliberately added quantities of oxygen function as catalysts to solubilize lignin at a very rapid rate under reaction conditions substantially milder than those employed in conventional oxygen bleaching of lignocellulosic pulps. Oxygen bleaching may, therefore, be conducted under milder conditions of temperature and pressure than are presently employed in conventional processes.

Even under the milder conditions of electrochemically generated ferricyanide catalyzed oxygen bleaching, extensive cellulose destruction still occurs and pulp bleached to a particular kappa level will have a cellulose viscosity level roughly equal to that of a similar pulp bleached by conventional oxygen processes to the same kappa level.

Another convenient method of reducing viscosity loss in oxygen bleaching under the conditions employed in commercial practice is the use of viscosity preservers, principally complexes of magnesium.

It has been found however that under the conditions of electrochemically promoted oxygen bleaching where the temperature is lower than that of conventional oxygen bleaching a substantially completely different group of compounds which are largely ineffective in reducing cellulose viscosity loss in conventional oxygen bleaching are effective in preventing such viscosity loss and enable bleaching to low kappa levels while retaining relatively high cellulose viscosities.

CITATION OF RELEVANT ART

A. Electrochemical Bleaching References

The most pertinent publications in this area of which applicants are aware are two Russian papers and a Russian Inventor's Certificate. These are S. B. Stromsky, E. I. Chupka, Wood Chemistry, U.S.S.R, 1978, N4, pp 11 to 14, "Electrochemical Way of Bleaching of Kraft Pulp"; E. I. Chupka et al., Bumazhnaya Promyshlennost (Paper Industry, USSR), 1978, N11, pp 20 to 21, "Chlorine-Free Ways of Electrochemical Bleaching of Pulp"; and Inventor's Certificate 596,687 to Chupka et al.

In these documents electrochemical bleaching of kraft pulp by electrogenerated ferricyanide is taught. Chupka et al. specifically teach that the bleaching is due to the use of ferricyanide as an electron carrier and note that the rate of bleaching is somewhat faster than bleaching under comparable conditions where no ferricyanide is present. Under the high voltage conditions employed by Chupka et al. a small amount of oxygen was concurrently produced with the ferricyanide but Chupka did not recognize the necessity of that oxygen in producing his result. Thus, no teaching or suggestion is provided by these authors that supplying an effective amount of oxygen from outside the system would permit extremely rapid bleaching even at voltages where oxygen is not generated concurrently with ferricyanide.

An additional related USSR Inventor's Certificate is number 535,383 to Chupka et al. The subject matter of this certificate is kraft pulp bleached by oxygen generated electrochemically. This reference is strictly concerned with supplying oxygen from the decomposition of water directly to pulp in situ rather than as a gas collected from the atmosphere. Catalysis of the reaction is not discussed.

Applicants are also aware of the following publication and patents:

"A Study of Some of The Variables in Bleaching Pulp in an Electrolytic Cell" by David R. Gustafson in TAPPI, 42, pp 612 to 616, (1959) which discusses bleaching of sulfite pulp with chlorine generated electrolytically in situ. This reference teaches only that chlorine generated in situ by electrolysis of chloride can be substituted for chlorine generated externally and supplied as an aqueous solution. Bleaching with other than chlorine is not suggested.

U.S. Pat. No. 1,780,750 which discusses the use of in situ electrolytically generated chlorine to bleach bagasse pulp.

U.S. Pat. No. 2,214,845 which discusses brightening of paper pulp and other materials through the use of ferricyanide to generate ferrous ferricyanide (Turnbull's Blue) thereby removing discoloration provided by the iron originally present and in addition adding "blueing" to the materials in question and reducing any inherent grayness due to other trace foreign substances. Electrochemical generation or regeneration of the ferricyanide and its potential use in delignifying bleaching is not mentioned.

U.S. Pat. No. 2,477,631 which deals with hypochlorite bleaching of paper pulp and other materials with the aid of water soluble salts of cobalt, nickel and manganese. Electrochemical delignifying bleaching and the generation and use of ferricyanide therein are not mentioned.

U.S. Pat. No. 2,828,253 which deals with electrochemical generation of chlorine for the pulping of straw, bagasse and the like.

U.S. Pat. No. 3,489,742 which deals with pulping of sisal and similar fibers using chlorine and alkali generated in situ electrochemically.

U.S. Pat. No. 4,141,786 which deals with the use of manganic ions generated in situ in pulp by treatment of precipitated manganous ions on the pulp with oxygen to delignify lignocellulosic pulps.

British Pat. No. 942,958 which deals with delignifying bleaching of lignocellulosic pulps by alkali and chlorine generated electrolytically in situ.

It is readily apparent that of all the above literature and patents, only the above cited Chupka references are really relevant and these do not teach or suggest the use of electrochemically generated ferricyanide to promote or assist bleaching by excess oxygen.

B. References related to viscosity preservation in conventional oxygen bleaching What is probably the reference of most interest in this group is U.S. Pat. No. 4,004,967 which teaches the use of formaldehyde, methanol, ethanol, isopropanol, glycerol, sorbitol, formic acid, or acetone in combination with a magnesium salt as cellulose viscosity preservers in conventional oxygen bleaching of pulp. As will be shown below a number of the above compounds are of structural types which are ineffective in electrochemically promoted oxygen bleaching.

U.S. Pat. No. 3,843,473 teaches the use of hydroxycarboxylic, aminopolycarboxylic and polyphosphoric acid complexes of magnesium as cellulose viscosity protectors in conventional oxygen bleaching processes.

U.S. Pat. No. 3,951,732 teaches the use of triethanolamine and magnesium compounds as cellulose viscosity protectors in conventional oxygen bleaching processes.

U.S. Pat. No. 4,091,749 teaches the use of monoethanolamine, methylamine and dimethylamine for pretreating wood which after substantially complete separation from the amines is then subjected to conventional soda-oxygen pulping.

U.S. Pat. No. 4,002,526 teaches the use of ammonia and compounds which liberate ammonia as cellulose viscosity protectors in conventional oxygen bleaching processes.

C. Reference to viscosity preservers in ozone/oxygen bleaching

U.S. Pat. No. 4,229,252 teaches that the presence of a small amount of a "water-soluble" alcohol enhances the bleaching efficiency of ozone on lignocellulosic material.

Applicants consider that given the substantial differences between electrochemically generated ferricyanide promoted oxygen bleaching and conventional oxygen or ozone/oxygen bleaching that the above references, singly or in combination provide no teaching enabling one to select a compound which predictably could be a cellulose viscosity preserver in electrochemically generated ferricyanide promoted oxygen bleaching.

SUMMARY OF THE INVENTION

The invention provides a process for delignification of lignocellulosic material which comprises treating said lignocellulosic material with a bleaching effective amount of oxygen and a catalytically effective amount of electrochemically generated ferricyanide ion in a substantially aqueous solution at alkaline pH in the presence of a cellulose viscosity protective amount of a cellulose protective compound selected from the group consisting of water soluble alcohols, water soluble primary and secondary amines, compounds capable of being hydrolyzed to produce said primary and secondary amines, diloweralkyl sulfoxides, water soluble ethers, and mixtures thereof.

The tangible embodiments produced by the process aspect of the invention possess the inherent physical characteristics of being relatively bright pulps when tested by standard brightness methods, and of having higher cellulose viscosity properties to comparable pulps bleached by oxygen to similar levels of residual lignin content under the conditions employed in prior art processes.

The tangible embodiments produced by the process aspect of the invention possess the inherent applied use characteristics, particularly when they are derived from wood pulp, of being suitable for the manufacture of paper and paperboard having strength properties superior to those obtained from prior art oxygen bleaching processes, thus, being useable for all standard uses of lignocellulosic pulp based paper and paperboard.

Special mention is made of embodiments of the invention wherein the lignocellulosic material is wood pulp, of embodiments wherein the wood pulp has been at least partly delignified by a conventional alkaline pulping process and of embodiments wherein the alkaline pH is from about pH 10 to about pH 15, preferably from about pH 13 to about pH 14.5.

Special mention is also made of embodiments of the invention wherein the cellulose protective compound is a water soluble primary or secondary amine, particularly a secondary amine.

DESCRIPTION OF THE DRAWING

The drawing FIGURE is a schematic representation of a preferred apparatus configuration for the practice of the invention.

DESCRIPTION OF THE PREFERRED EMBODIMENTS

The manner of practicing the process of the invention will now be described with reference to the drawing, employing as an illustration a preferred embodiment thereof, namely the bleaching of kraft (alkaline sulfide) softwood pulp 10*a* in a preferred form of apparatus to be described in detail hereinafter. Referring now to the drawing, to practice the process of the invention, the lignocellulosic material 10, conveniently softwood pulp 10*a* prepared by a conventional kraft (alkaline sulfide) pulping process to a lignin content and cellulose degree of polymerization typical of wood pulps prepared by such processes, conveniently to a lignin content, which is represented by a kappa number of about 40 and a cellulose viscosity number of about 30 may be suspended in an alkaline, conveniently about 1N in NaOH, ferricyanide solution 11 containing an amount of ferricyanide ion sufficient to provide a catalytically effective amount of ferricyanide, conveniently about 4 millimolar in $[Fe(CN)_6]^{-4}$, which has been saturated with oxygen gas 12 at normal temperature and pressure, conveniently at about 25° C. and atmospheric pressure and to which also has been added a cellulose protective amount, conveniently about 250 millimoles/liter, of a cellulose viscosity protective agent 29, conveniently dimethylamine 29*a*. The ferricyanide solution 11 may be obtained by passing a moderate electric current 13, conveniently about 90 m. Ampere, through a ferrocyanide solution of appropriate concentration. The ferricyanide solution 11 will be generated in the anode compartment 15 of an electrochemical cell 16, which may be conveniently separated from the cathode 14 by a semipermeable membrane 17. After saturation with oxygen 12 in standard fashion, the mixture of dimethylamine 29*a*, ferricyanide 11 and oxygen 12 may be continuously circulated though the pulp suspension 10 for a short period of time, conveniently about 3.5 hours, to produce a pulp having a kappa number of about 10.5 and a viscosity of about 26.5 cp. The spent solution 18 recovered from the pulp suspension 10 may be recirculated to the anode compartment 15 for reoxidation of ferrocyanide to ferricyanide and subsequent reintroduction of oxygen 12. In the anode compartment 15, in addition to ferricyanide being regenerated, solubilized lignin fragments in the spent solution 18 may be further oxidized. It is thought that this removal of dissolved lignin from the circulating liquor assists in maintaining the extractive power of the liquor for the chromophoric components of the lignocellulosic pulp. The resulting pulp, if desired, may be further bleached by any conventional bleach sequence, or it may be formed directly into paper.

As used herein and in the appended claims the term "a bleaching effective amount of of oxygen" means that the solution is at least saturated with oxygen gas at 25° C. and at normal atmospheric pressure.

The term "a catalytically effective amount of ferricyanide" means a concentration of ferricyanide in solution of from about 0.004% to about 0.400% by weight, preferably from about 0.015% at about 0.200% by weight.

As used herein and in the appended claims, the term "cellulose protective compound" contemplates water soluble alcohols such as methanol, ethanol, n-propanol, n-butanol, sorbitol, ethylene glycol, glycerol, soluble starch, methyl-beta-D-glycopyranoside, 3,4-dimethoxybenzyl alcohol and the like, water soluble primary and secondary amines such as dimethylamine, diethylamine, ethylamine, diethanolamine, ethylenediamine, ethanolamine, morpholine and the like, compounds capable of being hydrolyzed to produce said primary and secondary amines such as dimethyl formamide and the like, diloweralkyl sulfoxides such as dimethyl sulfoxide and water soluble ethers such as tetrahydrofuran and the like.

The term "a cellulose protective amount of a cellulose protective compound" contemplates from about 10 millimoles per liter to about 500 millimoles per liter of a cellulose protective compound.

The preferred amount for a particular cellulose protective compound 29 will be within that range but will vary according to the temperature of the solution and according to the particular cellulose protective compound desired to be employed. One of skill in the art may readily determine the optimum concentration for a particular compound at a particular temperature by employing a limited series of small scale experiments employing a graded series of concentrations of the compound. For example at 25° C. the preferred concentration of methanol is about 490 millimoles per liter, that of dimethylsulfoxide is 490 millimoles per liter, that of ethanol is 490 millimoles per liter, that of tetrahydrofuran is 490 millimoles per liter that of ethylene diamine is 250 millimoles per liter, that of dimethylamine 29*a* is 125 millimoles per liter to about 250 millimoles per liter, that of dimethylformamide is about 250 millimoles per liter, that of ethylamine is 250 millimoles per liter, and that of diethylamine is 125 to 250 millimoles per liter.

The pH of the ferricyanide solution 11 may vary from about 11 to about 15, preferably from about 13 to about 14. The temperature at which the process may be carried out is not particularly critical but conveniently should be less than the 90° to 120° C. at which conventional oxygen bleaching stages are normally carried out. The temperature may range upward from about 0° C. with about 25° to about 65° C. being preferred. When dimethylamine 29*a* is employed as the cellulose protective compound, temperatures of from about 25° C. to about 40° C. are preferred.

One of skill in the art will understand that the time required for the reaction will also depend upon the type of pulp, and the extent of prior delignification. One of skill in the art will be able to select a desired reaction period to optimize delignification while minimizing cellulose depolymerization employing kappa number and viscosity determinations already standard in the industry.

The concentration of the pulp 10 or other lignocellulosic material in the slurry is also not particularly critical and is largely limited by the difficulty of handling and diffusing reagents through pulp slurries which are too concentrated and the large volume and inordinate residence times involved with too dilute slurries. Normally wood pulp concentrations of from about 1% to about 40%, preferably from about 3% to about 5% and from about 25% to 35% all by weight are preferred because of the ease of handling slurries in these preferred consistency ranges.

The particular configuration of the apparatus employed to practice the invention is not particularly critical and may be any of the prior art described devices. Particularly preferred, however, is a device comprising an electrochemical cell 16 divided by a semipermeable membrane 17, such as a Nafion brand membrane sold by Dupont, into cathodic 14 and anodic 15 compartments employing, conveniently, a carbon electrode 19 in the cathode compartment 14. The anode compartment 15 is conveniently filled with loosely packed nickel shot 20 connected to EMF source 101 by wire 21. Cathode 19 is connected to EMF source 101 by wire 22. Anode compartment 15 is connected to tank 102 by tube 23. Tank 102 is connected to tower 103 by tube 24. Tower 103 is connected to pump 104 by tube 25. Pump 104 is connected to anode compartment 15 by tube 26.

In operation, ferrocyanide solution containing the cellulose protective compound 29 in the desired concentration may be introduced into the system. Passing an electric current 13 from EMF source 101 carried by wires 21 and 22 through electrochemical cell 16 produces ferricyanide solution 11 still containing the cellulose protective compound 29 in anode compartment 15. Ferricyanide solution 11 containing cellulose protective compound 29 passes through tube 23 into tank 102 where it is mixed with oxygen 12 introduced, conveniently as air, into tank 102 through tube 27. The mixture of cellulose protective compound 29, ferricyanide 11 and oxygen 12 passes through tube 24 into tower 103 containing lignocellulosic material 10. After a sufficient residence or dwell time to allow reaction with the lignocellulosic material 10, the now exhausted solution 18 is recirculated through tube 25, pump 104, and tube 26 to anode compartment 15 where it is reoxidized electrically to produce fresh ferricyanide solution 11 still containing the cellulose protective compound 29. Pump 104 provides the hydraulic pressure to produce the fluid circulation of solutions 11 and 18. The electrical potential of nickel anode 20 relative to a standard calomel electrode 28 is measured by voltmeter 105. The flow rate of solutions through the system is adjusted to provide a sufficient dwell time for the reaction to take place in tower 103.

The EMF required for the process of the invention as determined by the potential of the anode with reference to a standard calomel electrode may vary from about +0.2 volts to about +0.6 volts, with about +0.4 volts being preferred. The cell current automatically adjusts to oxidize all species passing through anode compartment 15 which are reactive at the electrical potential selected particularly the ferrocyanide which is completely reactive in this potential range. Thus, the current magnitude is dependent on the concentration of ferrocyanide entering the cell and on the concentration of oxidizable organic species, principally from lignin, extracted from the pulp.

At the anode potentials relative to a standard calomel electrode contemplated by the invention, no oxygen is generated at the anode.

"Kappa" number referred to herein is a measure of residual lignin in a lignocellulosic material and is determined according to TAPPI standard T236 os-76.

Pulp "viscosity" or "viscosity" referred to herein is a measure of the degree of polymerization of cellulose in the pulp. It is determined according to TAPPI standard T230 os-76. Decreasing pulp viscosity reflects an increasing degree of cellulose destruction via depolymerization.

Percent (%) change in viscosity versus control means the sum of viscosity with additive (Va) and - viscosity without additive (Vo) multipled by one hundred and divided by the viscosity without additive. That is:

$$\frac{100\,(Va - Vo)}{Vo}$$

Surprisingly and unpredictably it has been found that certain compounds which act as cellulose viscosity protectors in conventional oxygen bleaching show little or no effectiveness in preserving cellulose viscosity in electrochemically generated ferricyanide promoted oxygen bleaching. Included among these are formaldehyde, magnesium salts, urea, formic acid, acetone and ammonia. Reducing sugars and tertiary amines have also been found not to be useful.

Also, surprisingly and unpredictably it has been found that certain compounds which are effective in preserving cellulose viscosity in electrochemically generated ferricyanide promoted oxygen bleaching show little or no effect in preserving cellulose viscosity in conventional oxygen bleaching. Among these are the primary and secondary amines, dimethyl formamide formamide tetrahydrofuran and dimethyl sulfoxide.

It is, therefore, apparent that the utility of any particular compound in standard oxygen bleaching processes provides no indication as to its usefulness for cellulose viscosity preservation or for any other purpose in electrochemically generated ferricyanide promoted oxygen bleaching.

The following examples further illustrate the best mode contemplated by the inventors for the practice of their invention.

EXAMPLE 1

Portions of Northern softwood kraft pulp (10 g, kappa 39, viscosity 37) are treated at 25° C. for the time required to reach the kappa numbers shown (about 3.5 hours) by circulating through them 1.5 liters of 1N NaOH solution saturated with oxygen gas at 14 psi (pounds per square inch) containing ferricyanide ion generated from 1 millimole per liter potassium ferrocyanide subjected to a 90 milliampere current and containing either no additive as a control or the additive indicated.

| Additive | Additive Conc. (millimole/liter) | Kappa | Viscosity in centipoise, (cp) |
|---|---|---|---|
| None | — | 10 | 13.5 |

-continued

| Additive | Additive Conc. (millimole/liter) | Kappa | Viscosity in centipoise, (cp) |
|---|---|---|---|
| None | — | 11 | 15.0 |
| Dimethylamine | 125 | 11 | 22 |
| Dimethylamine | 250 | 10.5 | 26.5 |
| Methylamine | 250 | 11 | 24 |
| Dimethylformamide | 250 | 12 | 28 |
| Formamide | 250 | 11 | 18 |
| Urea | 490 | 8.2 | 14 |
| Dimethylsulfoxide | 490 | 10 | 20.5 |
| Methanol | 250 | 11 | 19 |
| Methanol | 490 | 11 | 20.5 |
| Methanol | 1240 | 11 | 23.5 |
| Ethanol | 250 | 10 | 20.5 |
| Ethanol | 490 | 11 | 19 |
| Ethanol | 1240 | 11 | 23.5 |
| Isopropanol | 1300 | 15 | 23.5 |
| n-butanol | 490 | 15 | 23.0 |
| Tetrahydrofuran | 490 | 11 | 21.0 |

EXAMPLE 2

Portions of northern softwood kraft pulp (10 g kappa 39, viscosity 37) are treated under conditions analogous to those described for Example 1 for a time sufficient for each portion to reach 12.0 kappa.

| Additive | Additive Conc. (millimole/liter) | Viscosity (cp) | % Change in Viscosity vs Control |
|---|---|---|---|
| None (control) | — | 16.1 | — |
| Urea | 490 | 17.3 | +7.5 |
| Formamide | 250 | 18.1 | +12.4 |
| Methanol | 490 | 21.0 | +30.4 |
| Dimethylsulfoxide | 490 | 22.4 | +39.1 |
| Ethanol | 490 | 20.1 | +24.8 |
| Tetrahydrofuran | 490 | 22.3 | +38.5 |
| Ethylenediamine | 250 | 24.1 | +49.7 |
| Diethylamine | 125 | 23.2 | +44.1 |
| Dimethylformamide | 250 | 27.4 | +70.2 |
| Dimethylamine | 250 | 24.5 | +52.2 |
| Ethylamine | 125 | 21.8 | +35.4 |
| Diethylamine | 250 | 23.0 | +42.9 |
| Dimethylamine | 125 | 22.5 | +39.8 |
| Dimethylamine | 500 | 27.0 | +67.7 |

EXAMPLE 3

Portions of northern kraft softwood pulp (10 g, kappa 39, viscosity 37) are treated under conditions analogous to those of examples 1 and 2 in the presence of 350 millimole/liter dimethylamine to kappa 12 with the exception that the temperatures and oxygen pressures are those shown below. The viscosity of the pulp at the end of each treatment is shown.

| Temperature (°C.) | Pressure (psi) | Viscosity (cp) |
|---|---|---|
| 60 | 47 | 12.9 |
| 40 | 29 | 16.8 |

This example shows the diminishing effectiveness of dimethylamine with increasing temperature. Dimethylamine is completely ineffective at conventional oxygen bleaching temperatures.

EXAMPLE 4

Portions of northern softwood kraft pulp (10, kappa 39, viscosity 37) are treated under conditions analogous to those of Example 1 except the temperature is 70° C. and the oxygen pressure is 30 psi in the presence of no additive (control) or the additives shown until a kappa of 14.0 is attained. The viscosities attained are shown.

| Additive | Additive Conc. (millimole/liter) | Viscosity (cp) | % Change in Viscosity vs Control |
|---|---|---|---|
| None | — | 16.4 | — |
| Methanol | 250 | 20.3 | +23.8 |
| Dimethylamine | 100 | 16.2 | −1.2 |
| Dimethylformamide | 100 | 16.5 | +0.6 |
| Dimethylformamide | 200 | 15.3 | −6.7 |
| Methanol | 500 | 21.2 | +29.3 |
| n-butanol | 250 | 22.2 | +35.4 |
| n-butanol | 25 | 20.1 | +22.6 |
| Ethylenediamine | 2 | 15.6 | −4.9 |

The subject matter which applicants regard as their invention is particularly pointed out and distinctly claimed as follows:

1. A process for the delignification of lignocellulosic material which comprises reacting said lignocellulosic material with about 0.004% to about 0.400%, by weight of oven-dried pulp, of electrochemically generated ferricyanide ion in a substantially aqueous solution which is at least saturated with oxygen at normal atmospheric pressure at alkaline pH and at a temperature from about 0° C. to about 65° C. in the presence of a cellulose viscosity protective amount of a cellulose protective compound selected from the group consisting of water soluble alcohols, water soluble primary and secondary amines, comopounds capable of being hydrolyzed to produce said primary and secondary amines, dilower alkyl sulfoxides, water soluble ethers and mixtures thereof.

2. A process as defined in claim 1 wherein the cellulose protective compound is a water soluble primary or secondary amine.

3. A process as defined in claim 1 wherein the cellulose protective compound is a water soluble primary amine.

4. A process as defined in claim 3 wherein the water soluble primary amine is ethylamine.

5. A process as defined in claim 3 wherein the water soluble primary amine is ethylenediamine.

6. A process as defined in claim 1 wherein the cellulose protective compound is a water soluble secondary amine.

7. A process as defined in claim 6 wherein the water soluble secondary amine is dimethylamine.

8. A process as defined in claim 1 wherein the cellulose protective compound is a water soluble alcohol.

9. A process as defined in claim 8 wherein the water soluble alcohol is methanol.

10. A process as defined in claim 1 wherein the lignocellulosic material is wood pulp.

11. A process as defined in claim 1 wherein the ferricyanide ion in the delignification process is generated by electrochemical oxidation of ferrocyanide ion.

12. A process as defined in claim 1 wherein the alkaline pH is from about pH 10 to about pH 15.

13. A process as defined in claim 1 wherein the alkaline pH is from about pH 13 to about pH 14.5.

14. A process as defined in claim 1 wherein the lignocellulosic material is hardwood chips, softwood chips or bagasse.

15. A process as defined in claim 1 wherein the ferricyanide ion is generated electrochemically employing an anode contacting the solution in which ferricyanide is generated said anode being maintained at a potential of +0.2 to +0.6 volts relative to a standard calomel electrode also contacting said solution.

16. A process as defined in claim 15 wherein the anode is maintained at a potential of about +0.4 volts relative to the saturated calomel electrode.

* * * * *